US008919660B2

(12) United States Patent
Osler et al.

(10) Patent No.: US 8,919,660 B2
(45) Date of Patent: Dec. 30, 2014

(54) END RESTRAINT FOR TURNOUT

(71) Applicants: Wilbur Osler, Mattituck, NY (US); Edward Constantine, Kansas City, MO (US)

(72) Inventors: Wilbur Osler, Mattituck, NY (US); Edward Constantine, Kansas City, MO (US)

(73) Assignee: Amsted RPS, Mattituck, NY (US)

( * ) Notice: Subject to any disclaimer, the term of this patent is extended or adjusted under 35 U.S.C. 154(b) by 159 days.

(21) Appl. No.: 13/771,166

(22) Filed: Feb. 20, 2013

(65) Prior Publication Data

US 2014/0231534 A1 Aug. 21, 2014

(51) Int. Cl.
*E01B 9/38* (2006.01)
*E01B 9/02* (2006.01)

(52) U.S. Cl.
CPC ..... *E01B 9/02* (2013.01)
USPC ..... 238/264; 238/287

(58) Field of Classification Search
USPC ..... 238/264, 265, 266, 280, 281, 287, 306, 238/278, 283, 268, 282, 284, 285, 286
See application file for complete search history.

(56) References Cited

U.S. PATENT DOCUMENTS

| | | | | |
|---|---|---|---|---|
| 5,782,406 | A * | 7/1998 | Igwemezie | 238/67 |
| 6,761,322 | B1 * | 7/2004 | Porrill et al. | 238/264 |
| 6,986,470 | B2 * | 1/2006 | Osler | 238/264 |
| 7,533,829 | B2 * | 5/2009 | Osler et al. | 238/264 |
| 7,766,249 | B2 * | 8/2010 | Osler | 238/317 |
| 8,056,826 | B2 * | 11/2011 | Osler et al. | 238/264 |
| 8,210,444 | B2 * | 7/2012 | Osler | 238/283 |
| 8,297,528 | B2 * | 10/2012 | Meyer | 238/264 |
| 2002/0011526 | A1 * | 1/2002 | Igwemezie | 238/287 |
| 2005/0045059 | A1 * | 3/2005 | Osler | 105/199.4 |
| 2009/0184172 | A1 * | 7/2009 | Osler et al. | 238/283 |
| 2011/0204154 | A1 * | 8/2011 | Boesterling et al. | 238/264 |
| 2012/0091216 | A1 * | 4/2012 | Osler | 238/283 |
| 2013/0233935 | A1 * | 9/2013 | Habel et al. | 238/264 |
| 2014/0231534 | A1 * | 8/2014 | Osler et al. | 238/287 |

* cited by examiner

*Primary Examiner* — Jason C Smth
(74) *Attorney, Agent, or Firm* — Andrew Wilford

(57) ABSTRACT

An assembly for securing at least one rail to a substrate has a longitudinally extending rail plate extending across and secured underneath the rail and having a pair of opposite ends. Respective end restraints at the ends of the rail plate each have a jaw fixed to the respective end of the rail plate and each formed with a vertically throughgoing passage. A respective rigid anchor hood is fixed to the substrate in each of the passages with an outer surface of the anchor hood spaced inward from an inner surface of the respective passage and forming an annular space therewith. A respective rubber bumper mass fills each of these spaces so that forces transverse to the rail are transmitted through the bumpers to the anchor hoods.

8 Claims, 7 Drawing Sheets

END RESTRAINT FOR TURNOUT

FIELD OF THE INVENTION

The present invention relates to an end restraint for a railroad rail. More particularly this invention concerns a resilient end restraint for use at a turnout.

BACKGROUND OF THE INVENTION

Railroad tracks are typically secured in critical locations such as turnouts where significant forces are exerted transverse to the tracks, with special end restraints. To this end the tracks are fixed to rail plates extending transverse to the tracks, and each end of each rail plate is in turn secured to the underlayment, typically of concrete in a high-stress area, by a respective resilient end restraint, such as described in U.S. Pat. Nos. 7,766,249, 8,056,826, or 8,210,444.

Such devices are extremely effective in preventing potentially harmful lateral shifting of the rails and rail plate. Under normal use, however, each end restraint is largely responsible only for bracing the track in one direction, that is the end restraint at one end is responsible for resisting movement transverse to the tracks in an outward direction toward that one restraint, and the restraint at the other end is responsible for resisting opposite forces.

As a result it is necessary to construct these end restraints each to withstand considerable forces, since they are primarily working one at a time.

OBJECTS OF THE INVENTION

It is therefore an object of the present invention to provide an improved end restraint.

Another object is the provision of such an improved resilient end restraint that overcomes the above-given disadvantages, in particular that is effective in compression in both directions.

A further object is to provide such an end restraint that is simple to manufacture, will have a long service life, and is easy to install and position.

SUMMARY OF THE INVENTION

An assembly for securing at least one rail to a substrate has according to the invention a laterally extending rail plate extending across and secured transversely underneath the rail and having a pair of opposite ends. Respective resilient end restraints at the ends of the rail plate each have a jaw fixed to the respective end of the rail plate and each formed with a vertically throughgoing passage. A respective rigid anchor hood is fixed to the substrate in each of the passages with an outer surface of the anchor hood spaced inward from an inner surface of the respective passage and forming an annular space therewith. A respective rubber bumper mass fills each of these spaces so that forces transverse to the rail are transmitted through the bumpers to the anchor hoods.

The considerable advantage of this system is that forces transverse to the tracks in both directions are resisted primarily in compression by both of the end restraints. In fact, the end restraint on one end of the rail plate has its jaw in compression and tension and the end restraint on the opposite end of the rail plate also has its jaw in compression and tension when a train passes, for instance in a turnout. Thus each turnout need only be designed to resist half the maximum load, making it a significantly less expensive piece of hardware to build.

According to the invention the anchor hoods are fixedly bolted to the substrate. The rail plate is similarly fixedly bolted to the jaws, normally using permanent fasteners such as so-called Huck bolts.

The anchor hood in accordance with the invention is, seen from above, of T-shape and the hole in the jaw is generally complementary so that faces of the anchor hood and jaw that confront each other extend parallel to the rails for compression and tension of the bumper on shifting of the rail, rail plate, and jaws transverse to the rail.

According to further features of the invention a rubber-metal compression pad is provided underneath and engaging the rail plate and is fixed between the rail plate and the substrate. Such a compression pad is primarily fixed in place by the end restraints.

The metal plate imbedded in the compression pad in accordance with the invention has upwardly extending side-edge flanges between which the rail plate fits so that it cannot move parallel to the rails relative to the rail plate. It also has a pair of downwardly extending end flanges that limit lateral displacement of the compression pad between the end restraints.

BRIEF DESCRIPTION OF THE DRAWING

The above and other objects, features, and advantages will become more readily apparent from the following description, reference being made to the accompanying drawing in which.

DETAILED DESCRIPTION

Figure 1:
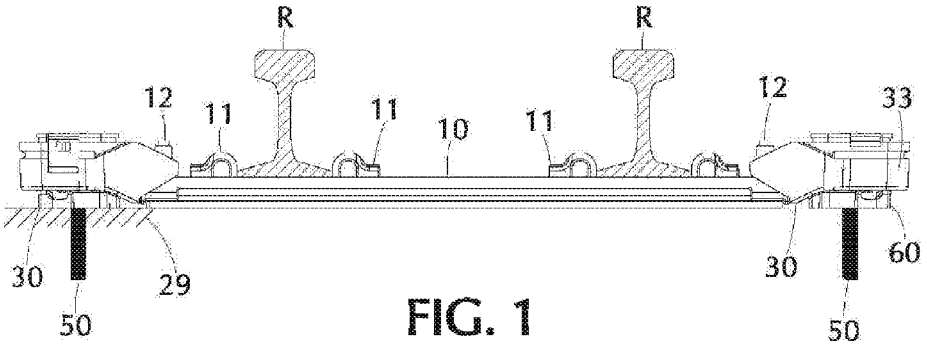
FIG. 1 is a longitudinal section through an end-restraint assembly according to the invention with two rails.
Figure 2:
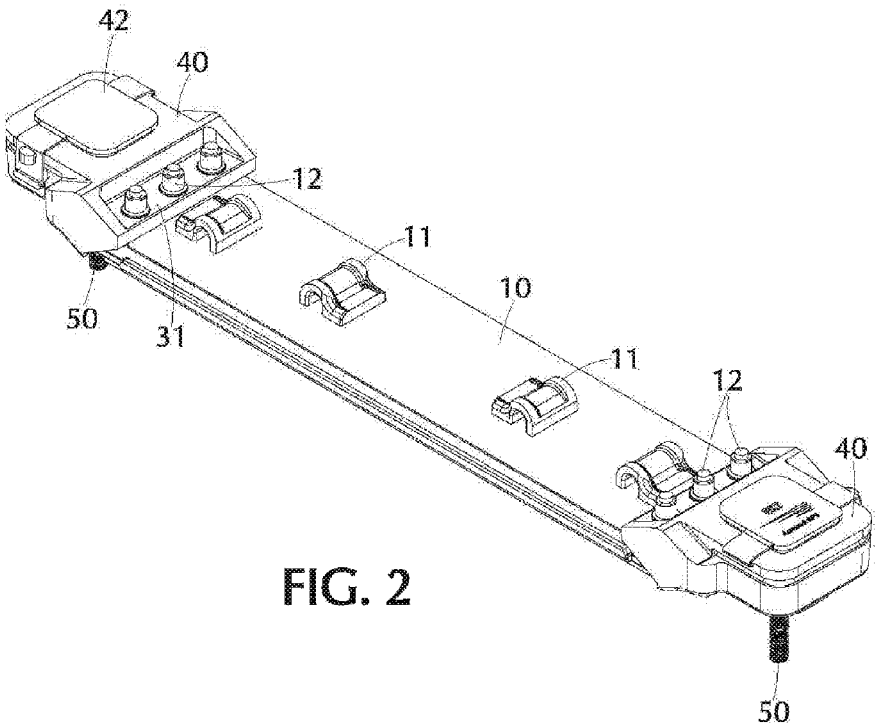
FIG. 2 is a perspective view of the assembly of FIG. 1 without the rails.

As seen in FIGS. 1 and 2 a rail-mounting assembly according to the invention serves to anchor a pair of rails R at a turnout, although the system could be used for a single rail at a turnout or other special trackwork.

Figure 3:
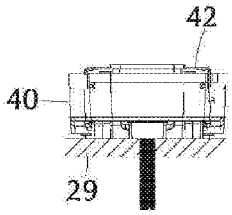
FIG. 3 is an end view of the assembly.
Figure 4:
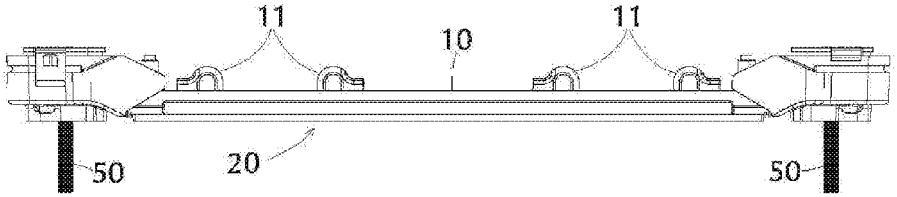
FIG. 4 is a side view of the assembly
Figure 5:
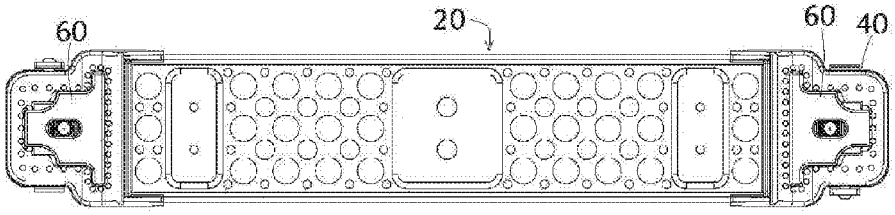
FIG. 5 is a bottom view of the assembly.
Figure 6:
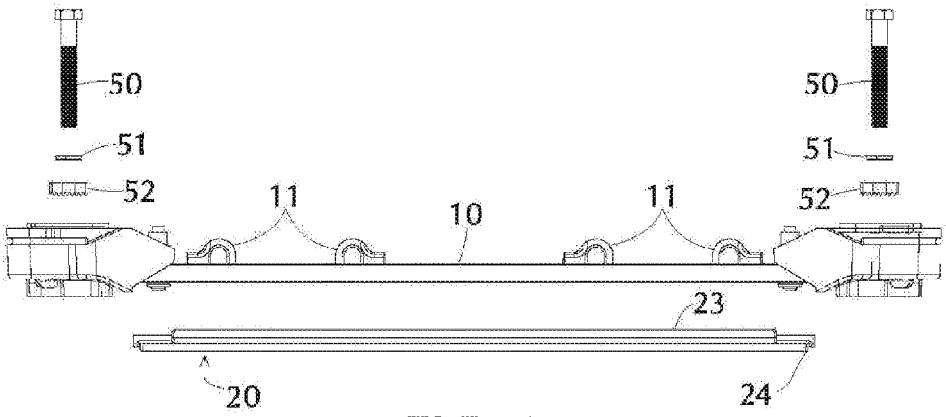
FIG. 6 is a side exploded view of the assembly.
Figure 7:
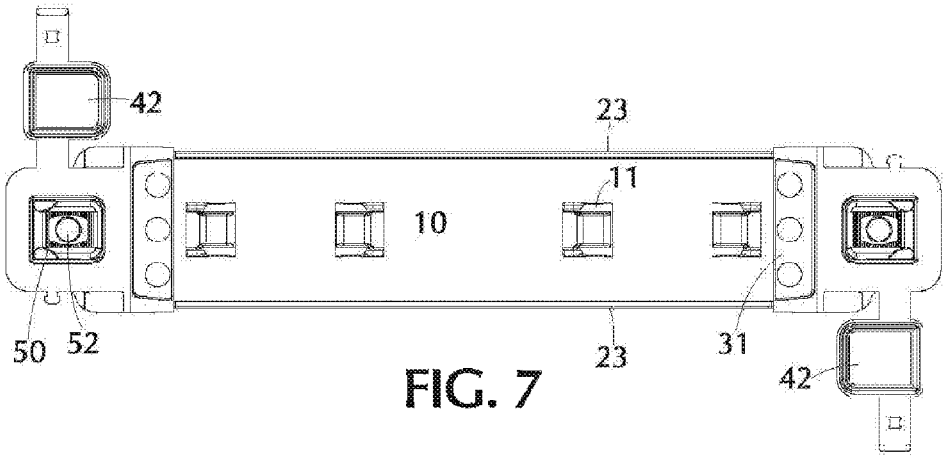
FIG. 7 is a top view with its end caps in the open position.

The assembly comprises a thick steel rail plate 10 to is which the rails R are fixed by, for instance, unillustrated spring clips secured in eyes 11, although other anchors are usable. The rail plate 10 sits via a compression pad 20 on a solid substrate normally made of concrete and shown schematically at 29 in FIGS. 1 and 3.

Figure 10:
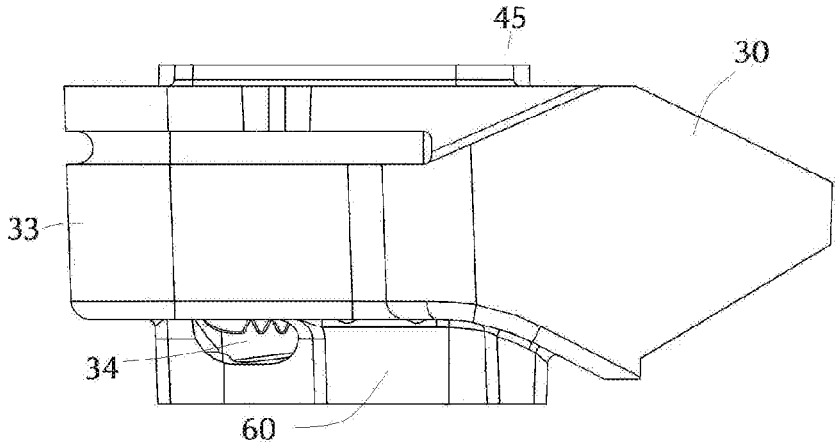
FIG. 10 is a side view of the subassembly of FIG. 8.
Figure 11:
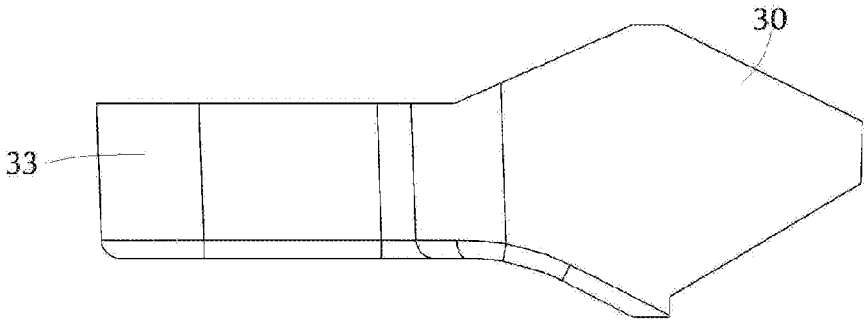
FIG. 11 is a side view of the mass.
Figure 12:
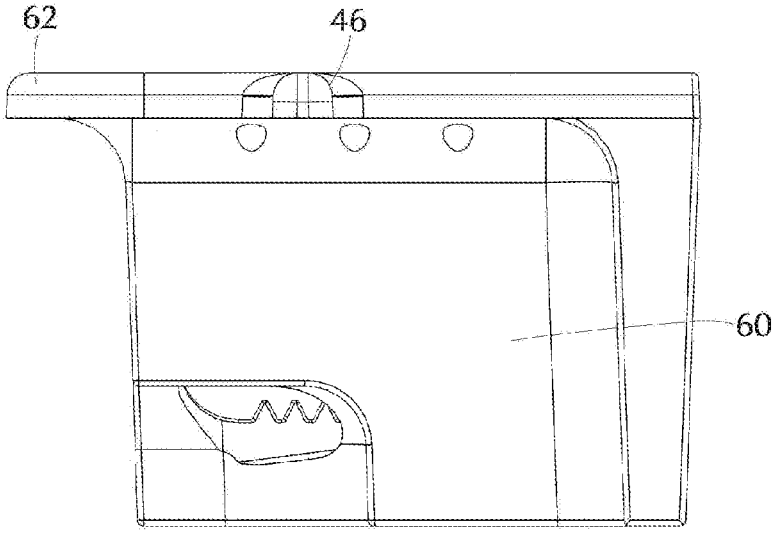
FIG. 12 is a side view of the anchor hood.

The track plate 10 is permanently fixed at each end by three so-called Huck bolts 12 to a flange 31 of a respective cast-iron jaw 30 each engaged via a respective rubber mass 40 (FIGS. 10 and 11) around a respective cast-steel anchor hood 60 (FIG. 12). The Huck bolts 12 are swaged permanently so that the connection of the plate 10 to the jaws 30 is integral and can only be undone by grinding or cutting away the swaged-on cap of the bolt 12. The anchor hoods 60 are fixed by respective bolts 50 to the substrate 29, with each bolt 50 extending vertically through a vertically throughgoing slot 61 formed in the respective anchor hood 60 and elongated transversely of the rails R. The bolts 50 have heads that bear downward via lock washers 51 and gauge plates 52 (see copending application atty's 30444 which is incorporated herewith by reference) on the respective anchor hoods 60.

Figure 13:
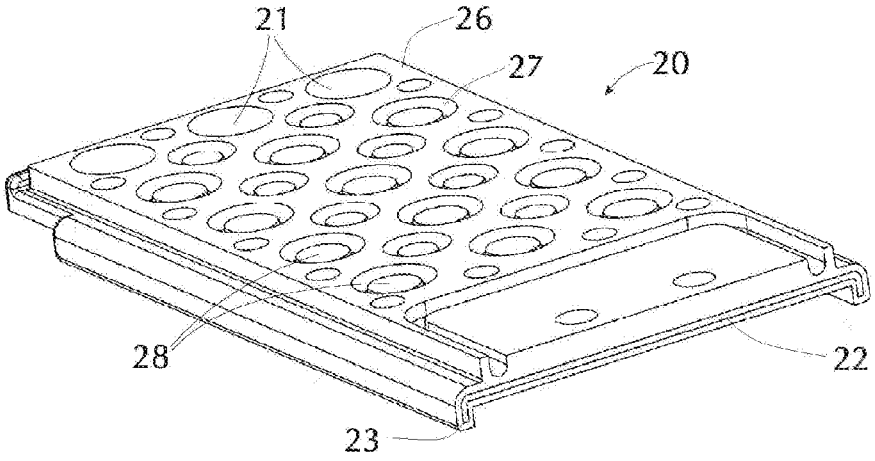
FIG. 13 is a small-scale sectional end view of the compression pad.
Figure 14:
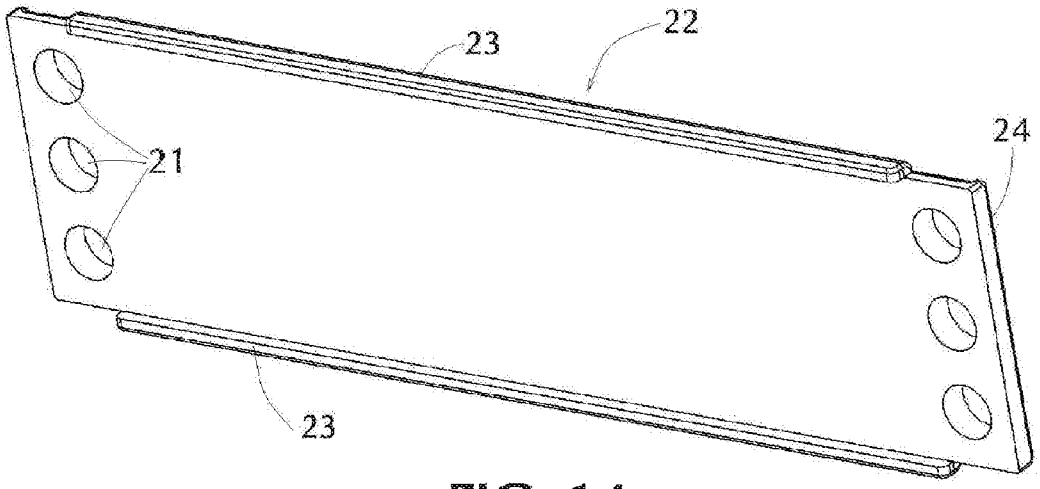
FIG. 14 is a small-scale perspective side view from below of the compression pad.

The compression pad 20 as shown in FIGS. 13 and 14 is basically of upwardly open U-section and is formed by a thin (⅛" thick) steel reinforcement plate 22 wholly surrounded and imbedded in a rubber layer or mass 23 and having as shown in FIG. 13 upstanding side flanges 23 that flank the rail plate 10 and downwardly extending end flanges 24 that laterally trap the mass 23. Thus once the rail plate 10 is secured to the jaws 30 by the Huck bolts 12, the compression pad 20 is captured underneath it with the rail plate between the flanges 23. Since the rail plate 10 is engaged between the flanges 23, the compression pad 20 cannot walk out from underneath the rail plate 10 as it is repeatedly compressed and released as a train passes over it. Thus the core plate 22 not only makes the compression pad 20 easier to handle, but also ensures that it will stay in place and not extrude from between the rail plate 10 and the substrate 29.

The compression pad 20 is formed at each end with three holes 21 that fit loosely around the bolts 50 underneath the flange 31 of the jaw 30 at the respective end of the plate 20.

Furthermore a lower rubber face 26 of the compression pad 20 is generally planar and lies in permanent surface-to-surface contact with the planar upper face of the substrate 29. This lower face 26 is formed with an array of recess 27 within which are formed bumps 28 whose lower end faces are spaced above the plane of the lower face 26. As a result vertical compression of the compression pad 20 has a dual spring characteristic that increases markedly when it is vertically compressed sufficiently to engage the lower faces of the bumps 28 with the substrate 29. The result is that the compression pad 20 resists compression when first loaded vertically up to a predetermined force, but when the load increases sufficiently that the bumps 28 engage the substrate 29, this resistance to compression increases markedly and further vertical compression is resisted with a significantly higher spring force. This means that it is not necessary to tradeoff performance with a heavy load, such as from a locomotive, against that of a lighter load, such as a passenger car, because the system will automatically respond to the higher load, when it is present, with a higher spring force.

Each jaw 30 has a flange 31 that is flat and horizontal but formed with upstanding collars 32 that project upward through the rubber mass 40. Furthermore, the jaw 30 has an annular part 33 outward of the respective flange 31 that surrounds the outer surfaces of the respective anchor hood 60. The part 33 has a generally T-shaped, stepped, and vertically throughgoing passage or drain hole 34 that is complementary to the vertical footprint or profile of the anchor hood 60, but somewhat larger so as to spacedly surround the anchor hood 60 on two sides. This annular space between the anchor hood 60 and the inner surface of the jaw 30 is filled by the bumper/mass 40 that also covers virtually all of the outer surfaces of the jaw 30 except its lower face and upper end faces of the collars 32 of the flange 31. Each anchor hood 60 further has as shown in FIG. 12 a lip 62 unitarily projecting outward on three sides and overhanging the annular part 33 of the respective jaw 30 to prevent liftup of this jaw 30.

This construction allows the jaw 30, together with the plate 10, to move laterally, that is parallel to the elongated rail plate 10 and transversely to the rails R, limitedly relative to the substrate 29 to which the anchor hoods 60 are anchored by the bolts 50. Since one such jaw 30 is provided at each end of the rail plate 10, this means that transverse or longitudinal forces effective on the rails R are shared by both of the end-restraint assemblies each formed by one anchor hood 60, one mass 40, and one jaw 30 having the annular part 33, so that each such assembly has to withstand half the lateral forces of the conventional such assemblies that only resist forces that are outward away from and perpendicular to the rails R, one of the assemblies working mainly in compression and the other mainly in tension.

Figure 8:
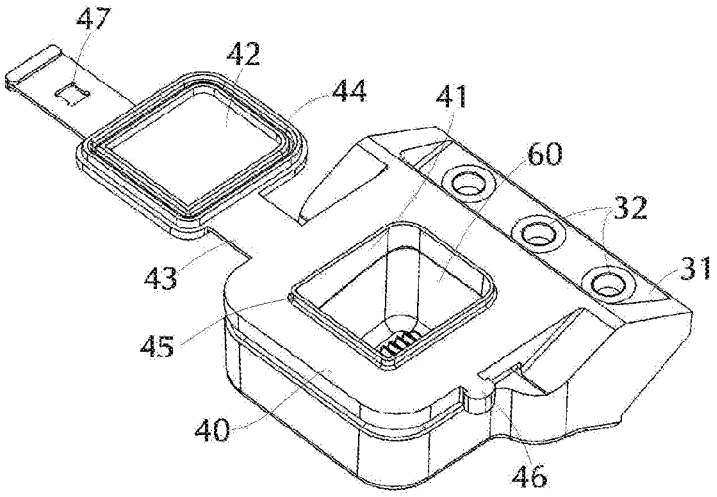
FIG. 8 is a perspective view of subassembly of the metal anchor hood and rubber mass, with the end cap open as in FIG. 7.
Figure 9:
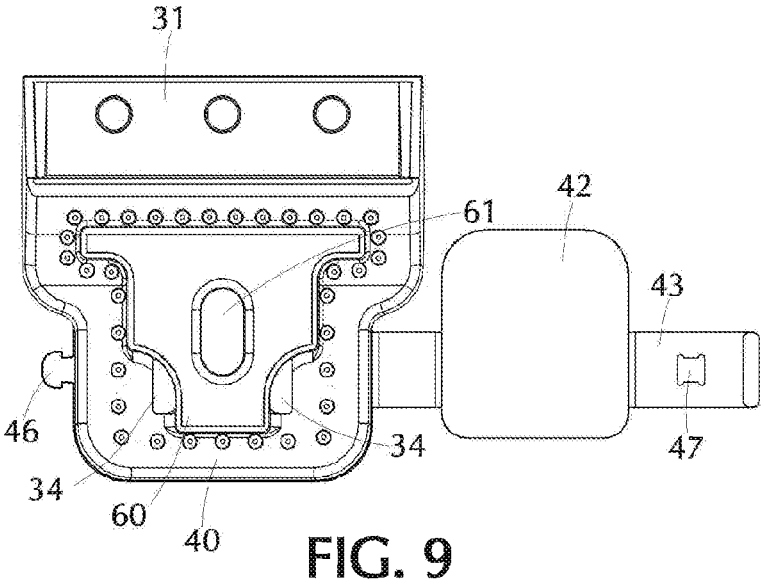
FIG. 9 is a bottom view of the subassembly of FIG. 8.

As shown in FIG. 8 each rubber mass 40 is formed with a central generally square hole 41 that the respective bolt 50 to be installed and tightened and that can be covered by a cap 42 carried on a strap 43 formed integrally with the cap 42 and with the rubber mass 40. A catch bump 46 projecting horizontally from the top edge of the anchor hood 60 can engage into a catch hole 47 on the end of the strap 43 to allow a frame-shaped seat 44 of the cap 42 to be held in place on a complementary ridge 45 on the top face of the mass around the hole 41 to allow this hole 41 to be covered up and sealed.

We claim:

1. An assembly for securing at least one rail to a substrate, the assembly comprising: a laterally elongated rail plate secured underneath the rail and having a pair of opposite ends; respective jaws fixed to the ends of the rail plate and each formed with a vertically throughgoing passage; a respective rigid anchor hood fixed to the substrate in each of the passages with an outer surface of the anchor hood spaced inward from an inner surface of the respective passage and forming an annular space therewith; and a rubber bumper filling the space, whereby forces transverse to and longitudinal of the rail from the rail plate are transmitted from the jaws through the rubber bumpers and shared by both of the anchor hoods in compression and tension.

2. The rail-securing assembly defined in claim 1, wherein the anchor hoods are fixedly bolted to the substrate.

3. The rail-securing assembly defined in claim 2, wherein the rail plate is fixedly bolted to the jaws.

4. The rail-securing assembly defined in claim 1, wherein each anchor hood is, seen from below, of T-shape and the passage in the jaw is generally complementary, whereby faces of the anchor hood and jaw confront each other on all sides and transmit forces of compression and tension to the bumper on shifting of the rail, rail plate, and jaws.

5. The rail-securing assembly defined in claim 1, further comprising a compression pad having:

a metallic plate underneath the rail plate and a rubber covering surrounding the metallic plate and that directly engages the rail plate and the substrate.

6. The rail-securing assembly defined in claim 5 wherein the metallic plate and rubber covering have upwardly extending edge flanges between which the rail plate fits.

7. The rail-securing assembly defined in claim 5 wherein the rubber covering is vulcanized to outer surfaces of the metallic plate.

8. The rail-securing assembly defined in claim 5 wherein the rubber covering of the compression pad has a lower face in which are formed a plurality of downwardly open recess in each of which is formed a rubber bump having a lower end face above a lower face of the pad, whereby, when the pad is vertically compressed to a predetermined extent, the lower end faces of the pad engage downward against the substrate.

* * * * *